US008388787B2

(12) United States Patent
Kaushal et al.

(10) Patent No.: US 8,388,787 B2
(45) Date of Patent: Mar. 5, 2013

(54) METHOD OF MAKING A COMPOSITE SHEET

(75) Inventors: Ramesh Kaushal, South Riding, VA (US); Leonard Peter Frieder, Dalton, PA (US); John LaJesse, Waymart, PA (US); Amit Chatterjee, Howrah (IN)

(73) Assignee: Gentex Corporation, Carbondale, PA (US)

( * ) Notice: Subject to any disclaimer, the term of this patent is extended or adjusted under 35 U.S.C. 154(b) by 289 days.

(21) Appl. No.: 12/835,406

(22) Filed: Jul. 13, 2010

(65) Prior Publication Data

US 2011/0011520 A1 Jan. 20, 2011

Related U.S. Application Data

(60) Provisional application No. 61/226,457, filed on Jul. 17, 2009.

(51) Int. Cl.
*B29C 70/32* (2006.01)
*B29C 70/84* (2006.01)

(52) U.S. Cl. ..... 156/174; 156/245; 156/272.2; 264/258

(58) Field of Classification Search ..... 156/173, 156/174, 175, 181, 245, 272.2; 264/258, 264/263
See application file for complete search history.

(56) References Cited

U.S. PATENT DOCUMENTS

| | | | | |
|---|---|---|---|---|
| 2,451,483 | A | | 10/1948 | Goldsmith |
| 2,940,886 | A | | 6/1960 | Nachtman |
| 2,964,442 | A | | 12/1960 | Hansen |
| 3,255,875 | A | | 6/1966 | Tierney |
| 4,123,832 | A | | 11/1978 | Schultz |
| 4,199,388 | A | | 4/1980 | Tracy et al. |
| 4,288,268 | A | | 9/1981 | Hartung |
| 4,495,231 | A | | 1/1985 | Laskaris et al. |
| 4,550,044 | A | | 10/1985 | Rosenberg et al. |
| 4,942,013 | A | * | 7/1990 | Palmer et al. ..... 264/511 |
| 4,943,334 | A | * | 7/1990 | Medney et al. ..... 156/174 |
| 5,112,667 | A | | 5/1992 | Li et al. |
| 5,173,138 | A | | 12/1992 | Blauch et al. |
| 5,175,040 | A | | 12/1992 | Harpell et al. |
| 5,190,809 | A | | 3/1993 | Marissen et al. |
| 5,269,863 | A | * | 12/1993 | Middelman ..... 156/177 |
| 5,460,676 | A | | 10/1995 | Jensen et al. |
| 5,534,343 | A | | 7/1996 | Landi et al. |
| 5,589,115 | A | | 12/1996 | Sherwood |
| 5,591,933 | A | | 1/1997 | Li et al. |
| 5,662,761 | A | | 9/1997 | Middelman et al. |
| 5,766,534 | A | | 6/1998 | White et al. |
| 5,874,152 | A | | 2/1999 | Middelman |
| 6,012,178 | A | | 1/2000 | Schuster et al. |
| 6,048,426 | A | | 4/2000 | Pratt |

(Continued)

FOREIGN PATENT DOCUMENTS

| | | | |
|---|---|---|---|
| WO | WO 2007/019951 A1 | * | 2/2007 |
| WO | WO 2007/080113 | | 7/2007 |

(Continued)

*Primary Examiner* — Michael Tolin
(74) *Attorney, Agent, or Firm* — Morgan, Lewis & Bockius LLP

(57) ABSTRACT

The invention relates to a method of making a composite sheet. A plurality of layers is first assembled, each layer being comprised of an untreated, unidirectional array of strands. The assembled layers are then placed adjacent one another to form an assembled sheet, with adjacent layers being in a non-parallel orientation, and without any of the layers having been treated with a matrix or binding component. The assembled sheet is then impregnated with a matrix component, which comprises a binding component and may also comprise a radiation-absorbing component.

14 Claims, 8 Drawing Sheets

U.S. PATENT DOCUMENTS

| | | | |
|---|---|---|---|
| 6,183,834 | B1 | 2/2001 | van der Loo |
| 7,228,571 | B2 | 6/2007 | Cheese |
| 7,384,585 | B2 | 6/2008 | Ishibashi et al. |
| 7,407,900 | B2 | 8/2008 | Cunningham |
| 2004/0096660 | A1 | 5/2004 | Awad et al. |
| 2007/0119538 | A1 | 5/2007 | Price et al. |
| 2007/0194490 | A1 | 8/2007 | Bhatnagar et al. |
| 2008/0124513 | A1 | 5/2008 | Eleazer et al. |
| 2008/0168645 | A1 | 7/2008 | Grasty |
| 2010/0139855 | A1 * | 6/2010 | Edler et al. ..... 156/272.2 |

FOREIGN PATENT DOCUMENTS

| | | |
|---|---|---|
| WO | WO 2008/054372 | 5/2008 |
| WO | WO 2008/098771 | 8/2008 |
| WO | WO 2008/101138 | 8/2008 |

* cited by examiner

METHOD OF MAKING A COMPOSITE SHEET

CROSS REFERENCE TO RELATED APPLICATION

This application claims the benefit of U.S. Provisional Application No. 61/226,457, filed Jul. 17, 2009.

BACKGROUND OF THE INVENTION

This invention relates generally to a method of making a composite material.

A composite material is constructed by assembling an arrangement of reinforcing fibers, then encapsulating or embedding the fiber arrangement in a binder or "matrix" material. Such composite materials have application as ballistic articles such as bulletproof vests, helmets, and structural members of military and law enforcement vehicles, as well as briefcases, raincoats, parachutes, umbrellas, and other items. Fibers conventionally used include aramid fibers, graphite fibers, nylon fibers, ceramic fibers, glass fibers, and the like.

It is known in the art to construct the building blocks for impact resistant composites—known as prepreg layers—by bonding or laminating together individual layers of unidirectional coplanar fibers that have been impregnated with a matrix material. Generally, the individual fibers are impregnated with the matrix material by immersing them in a bath or film of the matrix material before forming each prepreg layer so that the individual strands within each layer have sufficient structural integrity to remain coplanar. It is also known in the art to orient adjacent unidirectional fiber layers non-parallel to one another to increase the structural integrity of the prepreg layers.

A problem with these known techniques is that a large amount of matrix material must be used to create the composite material, which increases both the assembled weight and the cost of creating the composite material. Prior art methods for constructing a composite material have taught away from assembling multiple adjacent layers of unidirectional fibers without first treating the individual fibers and/or fiber layers with a matrix component. These prior art references have reasoned that the distribution of the fiber layers will be disordered by the impregnation process if matrix material is not already present on the individual fibers or fiber layers, hence causing technical issues such as the occurrence of sink marks due to differences in fiber volume fractions, and thereby damaging the structural integrity of the composite material. Furthermore, as noted above, the prior art has reasoned that impregnating the individual strands before forming them into prepreg layers is necessary to give the individual strands sufficient structural integrity to remain coplanar within each layer.

Hence, an improved method is needed for constructing a composite material that minimizes the amount of matrix component that is required to impregnate the fiber arrangement, while not diminishing the performance characteristics of the constructed composite sheet.

Relevant prior art patents include U.S. Pat. No. 5,112,667, U.S. Pat. No. 5,480,706, and U.S. Pat. No. 5,874,152.

BRIEF DESCRIPTION OF THE DRAWINGS

The present invention will hereinafter be described in conjunction with the appended drawing figures wherein like numerals denote like elements.

DETAILED DESCRIPTION OF THE PREFERRED EMBODIMENTS

Figure 1:
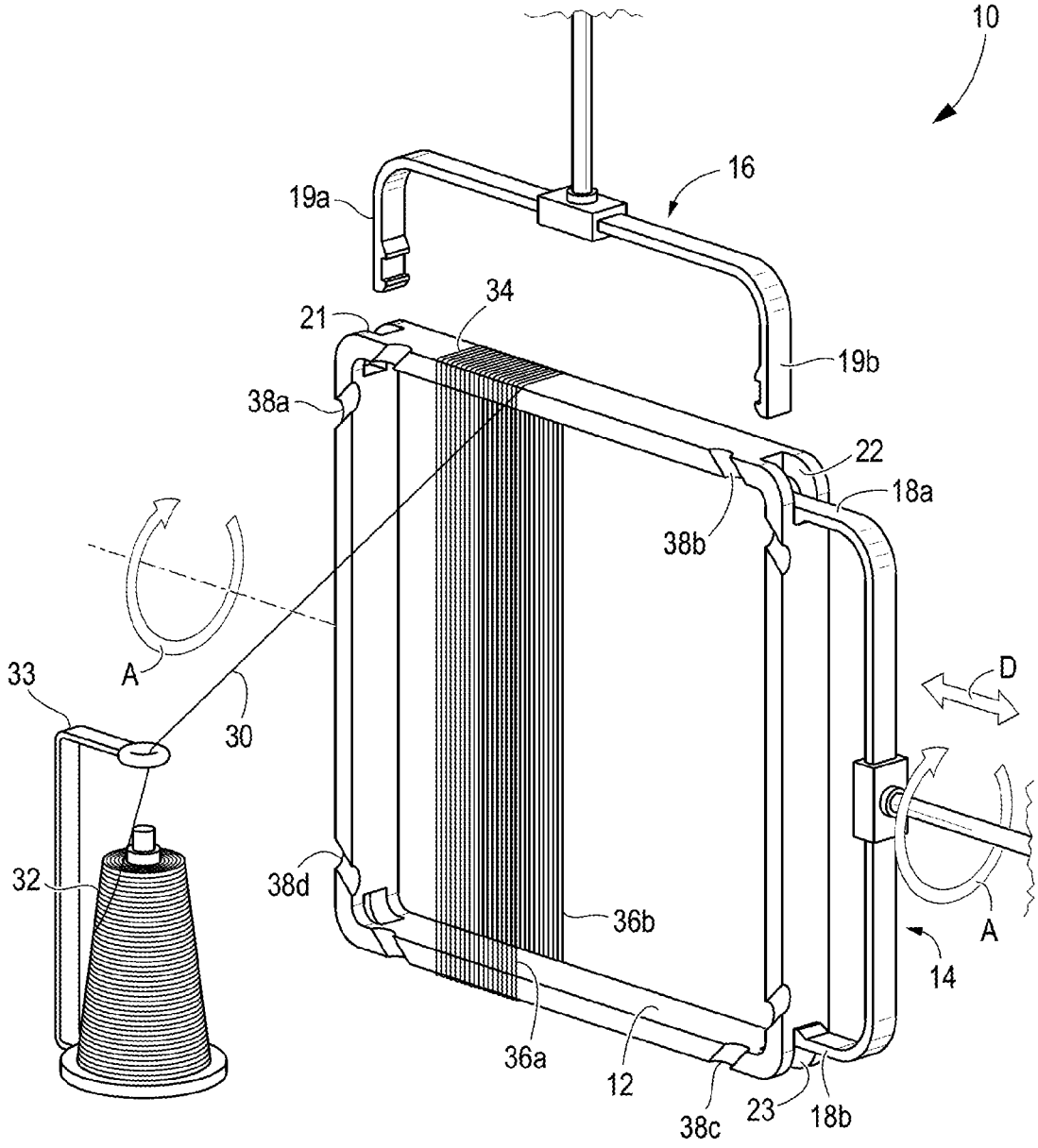
FIG. 1 is a perspective view showing a winding station in which a first strand pass is being wound around a strand frame.

The ensuing detailed description provides preferred exemplary embodiments only, and is not intended to limit the scope, applicability, or configuration of the invention. Rather, the ensuing detailed description of the preferred exemplary embodiments will provide those skilled in the art with an enabling description for implementing the preferred exemplary embodiments of the invention. It being understood that various changes may be made in the function and arrangement of elements without departing from the spirit and scope of the invention, as set forth in the appended claims.

To aid in describing the invention, directional terms are used in the specification and claims to describe portions of the present invention (e.g., upper, lower, left, right, etc.). These directional definitions are merely intended to assist in describing and claiming the invention and are not intended to limit the invention in any way. In addition, reference numerals that are introduced in the specification in association with a drawing figure may be repeated in one or more subsequent figures without additional description in the specification in order to provide context for other features.

As used herein, the term "strand" means a long fiber reinforcing component of a composite material, including, but not limited to, a string, fiber, yarn, thread, fibril, or filament, whether a monofilament or an aggregate of filaments, whether chemically treated or untreated.

Figure 2:
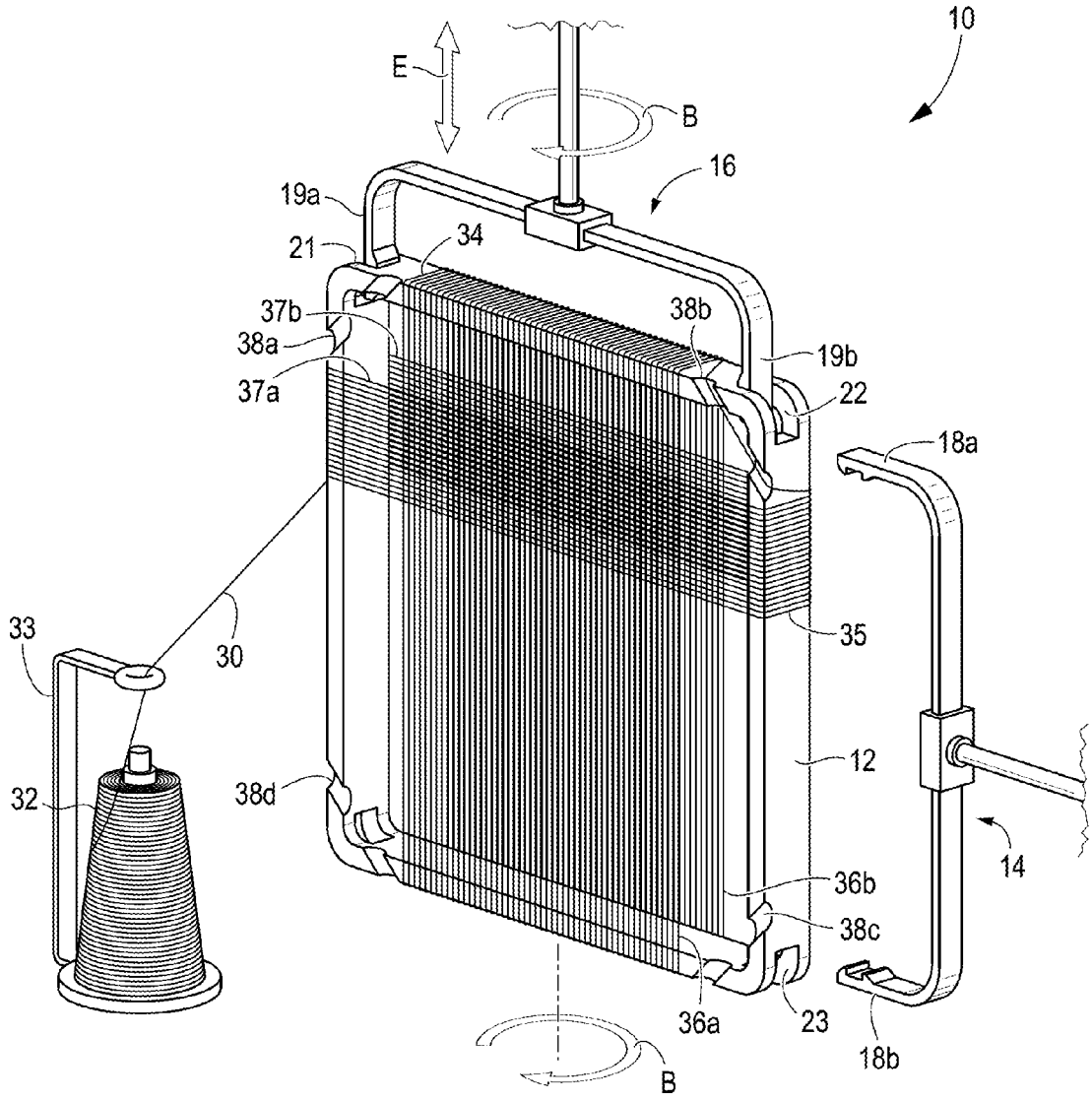
FIG. 2 is a perspective view showing the winding station of FIG. 1, with the first strand pass fully wound and a second strand pass being wound around the strand frame.

FIGS. 1 and 2 show an exemplary embodiment of a winding station 10. In this embodiment, a guide 33 guides a strand 30 as it is unraveled from a spool 32. In this embodiment, the strand 30 is being fed around a strand frame 12 to create a first strand pass 34, which is partially completed in FIG. 1. In this embodiment, creation of the first strand pass 34 is accomplished by engaging the strand frame 12 with a frame support apparatus 14. The frame support apparatus 14 has support arms 18*a*, 18*b* which engage, respectively, with support points 22, 23 located at corners of the strand frame 12. While the frame support apparatus 14 is engaged with the strand frame 12, the frame support apparatus 14 is rotated in a first winding direction A. As the frame support apparatus 14 is being rotated in the first winding direction A, it also moves intermittently in a direction D. Rotation of the frame support apparatus 14 in the first winding direction A and movement of the strand frame 12 in the direction D allows the strand 30 to feed from the spool 32, through the guide 33, and around the strand frame 12 to create the first strand pass 34. The first strand pass 34 is comprised of a pair of strand layers 36*a*, 36*b*, each located on an opposing side of the strand frame 12. While the first strand pass 34 is being created, the frame support apparatus 16 is disengaged from the strand frame 12. In this embodiment, the first strand pass 34 is comprised of unidirectional strands.

The speed of rotation of the frame support apparatus 14 in the first winding direction A is variable, and dependent on such factors as, for example, the desired distance between the individual strands that comprise the first strand pass 34 and the diameter of the strand 30. Movement of the strand frame 12 in the direction D is variable and dependent on the proximity of the strand 30 to the top or bottom of the strand frame 12. That is, in order to achieve a strand pass 34 having unidirectional strands 30 that are precisely perpendicular to left and right sides of the strand frame 12, movement of the strand frame 12 in the direction D occurs only while the strand 30 is being wound around the upper or lower edge of the strand frame 12, i.e. once per revolution. As a result, the strand 30 is at a slight angle as it is being wrapped around, for example, the top edge of the strand frame 12. A series of shallow channels or raised dimples (not shown) could be arranged on the outer edges of the strand frame 12 to help guide the strand 30 as it is wrapped around the strand frame. The size and spacing of the channels or dimples would depend on factors such as, for example, the thickness of the strand 30 and the desired strand pass spacing.

In FIG. 2, the first strand pass 34 is fully completed. The strand 30 is then fed around the strand frame 12 to create a second strand pass 35, which is shown partially completed in FIG. 2. Like the first strand pass 34, the second strand pass 35 is comprised of unidirectional strands. Creation of the second strand pass 35 is accomplished by engaging the strand frame 12 with the frame support apparatus 16. Frame support apparatus 16 has support arms 19*a*, 19*b* which engage, respectively, with support points 21, 22 located at corners of the strand frame 12. While the frame support apparatus 16 is engaged with the strand frame 12, the frame support apparatus 16 is rotated in the second winding direction B. As the frame support apparatus 16 is being rotated in the second winding direction B, it also moves intermittently in a direction E. It should be understood that in this embodiment the second strand pass 35 is constructed in the same manner as the first strand pass 34, described above. The second strand pass 35 is comprised of a pair of strand layers 37*a*, 37*b*, each located on an opposing side of the strand frame 12. While the second strand pass 35 is being created, the frame support apparatus 14 is disengaged from the strand frame 12.

In this embodiment, the first and second strand passes 34, 35 are oriented such that their respective strands are arranged orthogonally to one another on either side of the strand frame 12; that is, strand layer 36*a* is oriented orthogonal to strand layer 37*a*, and strand layer 36*b* is oriented orthogonal to strand layer 37*b*. If a third strand pass were constructed on top of the second strand pass 35, its respective strand layers would preferably be oriented orthogonal to the strand layers 37*a*, 37*b* of the second strand pass 35. Though it is preferable to have orthogonal arrangement of adjacent strand passes, it should be understood that any non-parallel relative orientation of the adjacent strand passes could be used. This non-parallel strand pass orientation will be paramount to the structural integrity of the fully constructed composite material, as will be discussed in greater detail below.

Several embodiments of the winding station 10 could be used to achieve the precise orthogonal orientation of adjacent strand passes. In a preferred embodiment, at the end of formation of the first strand pass 34, the strand 30 may be situated in a groove 38*b* at the upper right corner of the strand frame 12. The groove 38*b* is oriented so that the strand 30 is guided from one edge of the strand frame 12 (e.g., the top edge in FIG. 1) to an adjacent edge (e.g., the right edge in FIG. 1). In a preferred embodiment, the strand 30 is guided through the groove 38*b* by the combined engagement and movement of the frame support apparatuses 14, 16. Once the strand 30 is in position on the right edge of the strand frame 12, frame support apparatus 14 disengages from the strand frame 12, and winding of the second strand pass 35 begins. Grooves 38*a*, 38*c*, and 38*d*, located at the other corners of the strand frame 12, allow for transitioning between adjacent strand passes where a strand pass terminates at one of these other corners of the strand frame 12. It should be understood that identical grooves 39*a*-39*d* (not shown) may also be placed on the reverse side of the strand frame 12.

The above winding method is provided by way of example only. It should be understood that many other methods of winding the strand passes could be employed, such as for example, where the strand frame 12 is maintained in a stationary position and the spool 32 and/or guide 33 is rotated around the strand frame, or multiple spools, strands, or guides are used to create the unidirectional strand passes. It should be further understood that many other techniques and apparatuses could be used to affect the orthogonal orientation of adjacent strand passes within the scope of this invention. For example, one or more mechanical guide arms (not shown) could be used to carefully support and direct the strand 30 in order to affect the orthogonal orientation of the adjacent strand passes.

Figure 4:
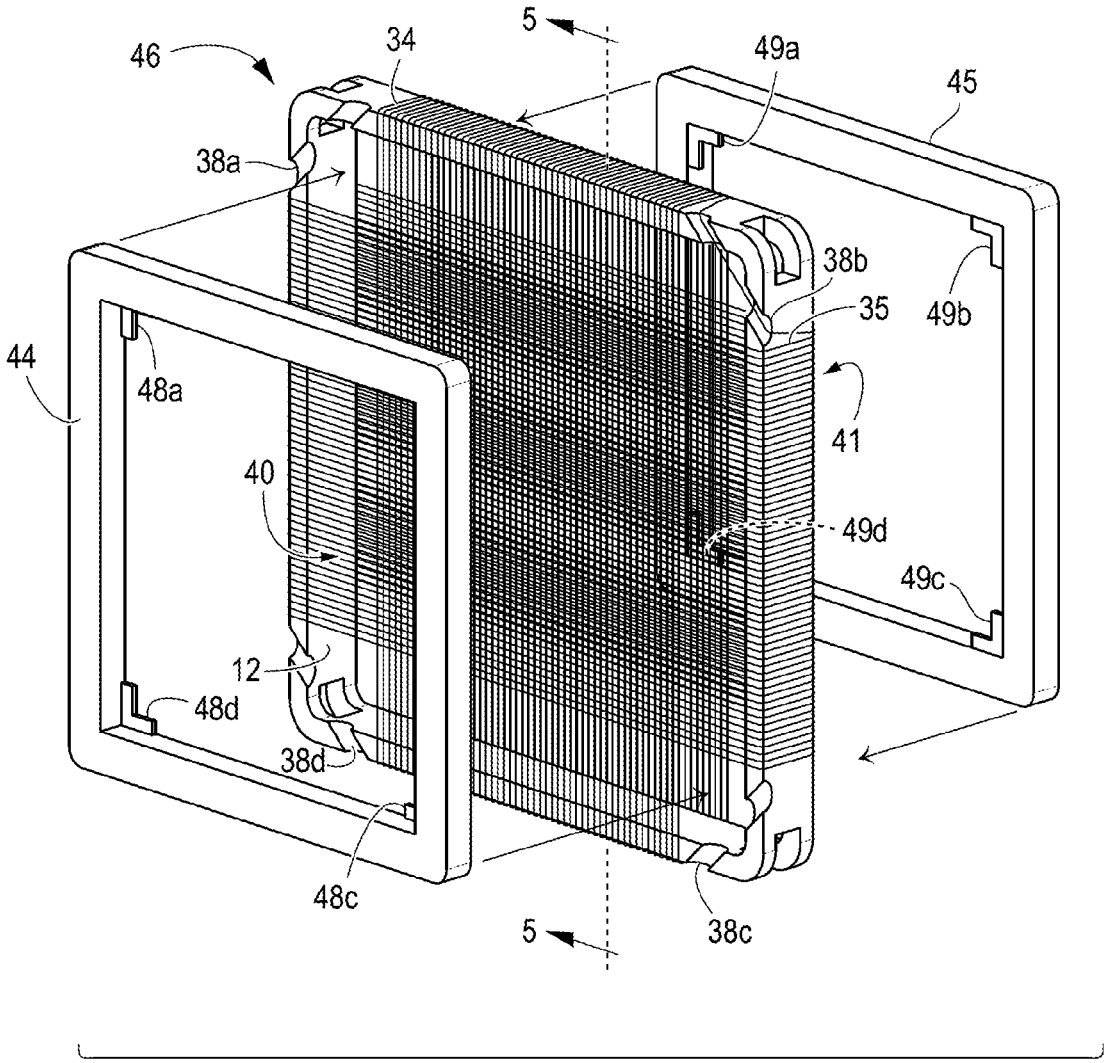
FIG. 4 is a perspective view showing two nesting frames that are to be inserted into the fully wound strand frame.

In the present embodiment, a total of two strand passes 34, 35 are assembled (see FIG. 4). It should be understood, however, that any number of desired strand passes could be created in accordance with, for example, the particular design specifications, cost sensitivities, and time constraints which may dictate the creation of the composite material. For example, a third strand pass could be assembled on top of the second strand pass 35. A fourth strand pass could then be assembled on top of the third strand pass. This process could continue until the desired number of strand passes is reached. In the present embodiment, the first and second strand passes 34, 35 are constructed from a continuous length of strand 30. In the alternative, each strand pass could be constructed from a separate length of strand 30.

Figure 3:
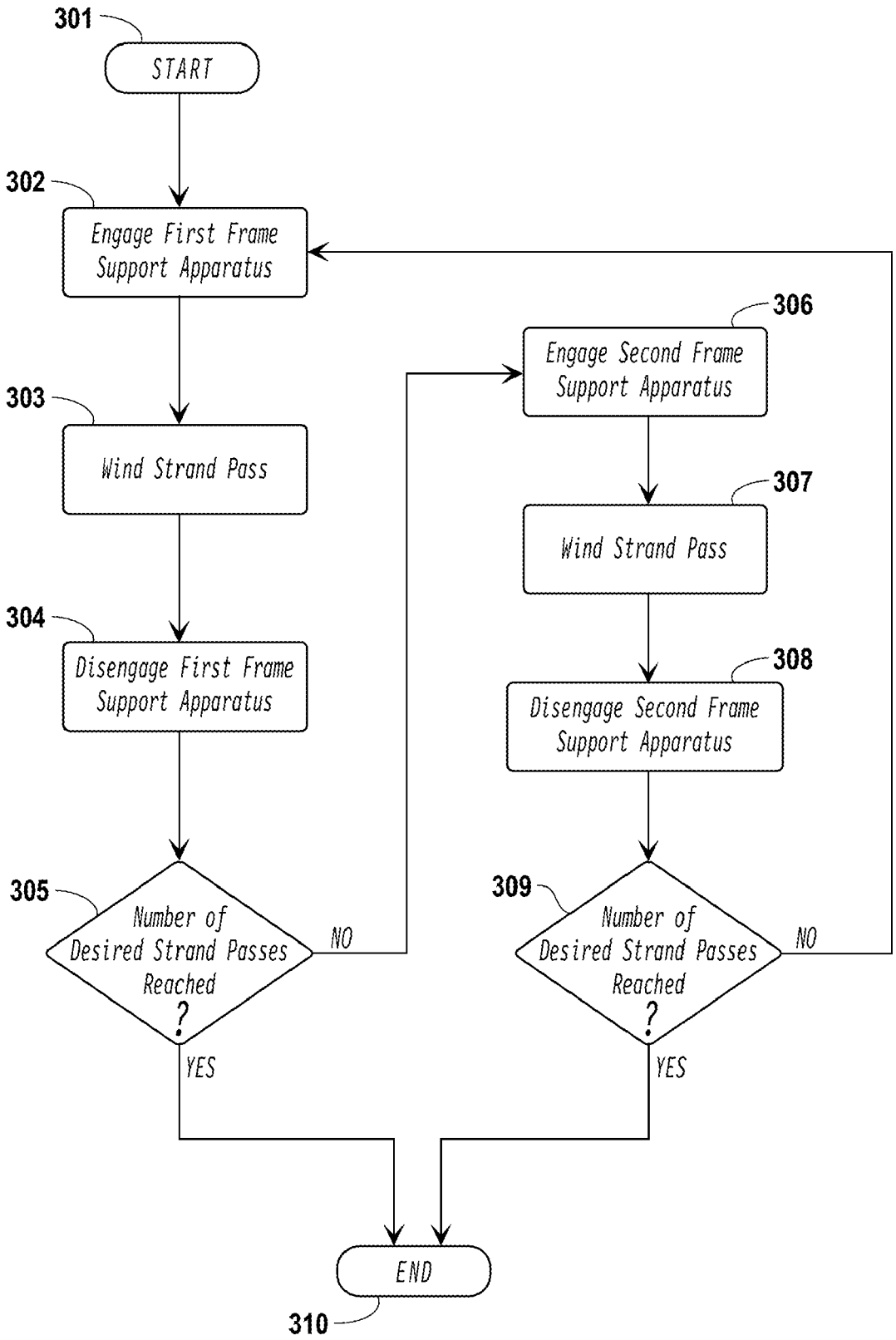
FIG. 3 is a flow chart showing an exemplary process for constructing a fully wound strand frame.

FIG. 3 is a flow chart showing the functional steps involved in an exemplary winding method of the strand frame 12. The process begins at step 301. At step 302, the frame support apparatus 14 engages the strand frame 12. The first strand pass 34 is wound at step 303, followed by the frame support apparatus 14 disengaging from the strand frame 12 at step 304. At step 305, a determination is made whether the desired number of strand passes has been reached. If it is determined that the desired number of strand passes has not been reached, the frame support apparatus 16 engages the strand frame 12 at step 306. The second strand pass 35 is wound at step 307, followed by the frame support apparatus 16 disengaging from the strand frame 12 at step 308. At step 309, a second determination is made whether the desired number of strand passes has been reached. If it is determined at step 309 that the desired number of strand passes has not been reached, the method returns to step 302. If it is determined at either of steps 305 or 309 that the desired number of strand passes has been reached, the process ends at step 310.

Figure 5:
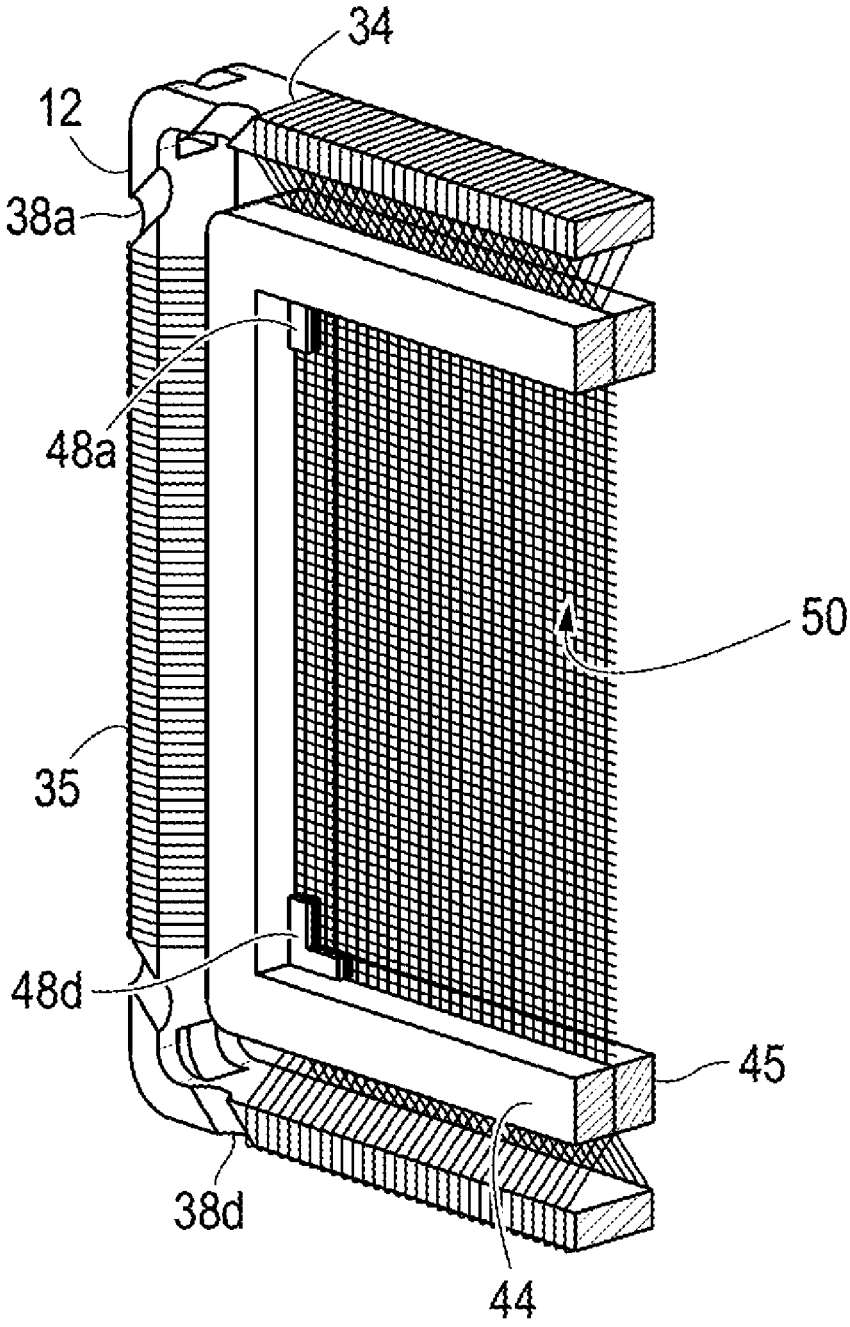
FIG. 5 is a sectional view taken along 5-5 of FIG. 4, showing the nesting frames pressed together to create an assembled sheet.

Referring now to FIGS. 4-5, strand layers 36*a*, 37*a* comprise a first layer set 40, which is located on the side of the strand frame 12 closer to the first nesting frame 44. Strand layers 36*b*, 37*b* comprise a second layer set 41, which is located on the side of the strand frame 12 closer to the second nesting frame 45. In FIG. 4, the first and second nesting frames 44, 45, which are adapted to be inserted within the strand frame 12, are shown with arrows indicating their respective insertion direction.

An exemplary method for pressing the first and second layer sets 40, 41 together will herein be described. The first and second nesting frames 44, 45 are placed against the first and second layer sets 40, 41, respectively, and then pressed together inside of the strand frame 12. As the first and second nesting frames 44, 45 are pressed together, as seen in the sectional view of FIG. 5, the first and second layer sets 40, 41 are brought adjacent to one another to form the assembled sheet 50. The first and second nesting frames 44, 45 could be brought together in a variety of ways, for example, by being pressed together manually or by being guided into their respective positions by the use of one or more support means. Further, the first and second nesting frames 44, 45 could have means for being releasably adjoined to each other, such that any means that may be used to press the first and second nesting frames 44, 45 into the strand frame 12 would not need to apply continuous pressure to keep the first and second nesting frames 44, 45 adjacent another. The first and second nesting frames 44, 45 act to maintain the strand layers 36*a*, 36*b*, 37*a*, 37*b* firmly and fixedly in a uniform orientation. As will be discussed below, impregnation of the assembled sheet 50 with a matrix component will subsequently occur. The present method overcomes technical difficulties related to disorientation of the strand layers as the matrix component is introduced to the assembled sheet 50.

Figure 6:
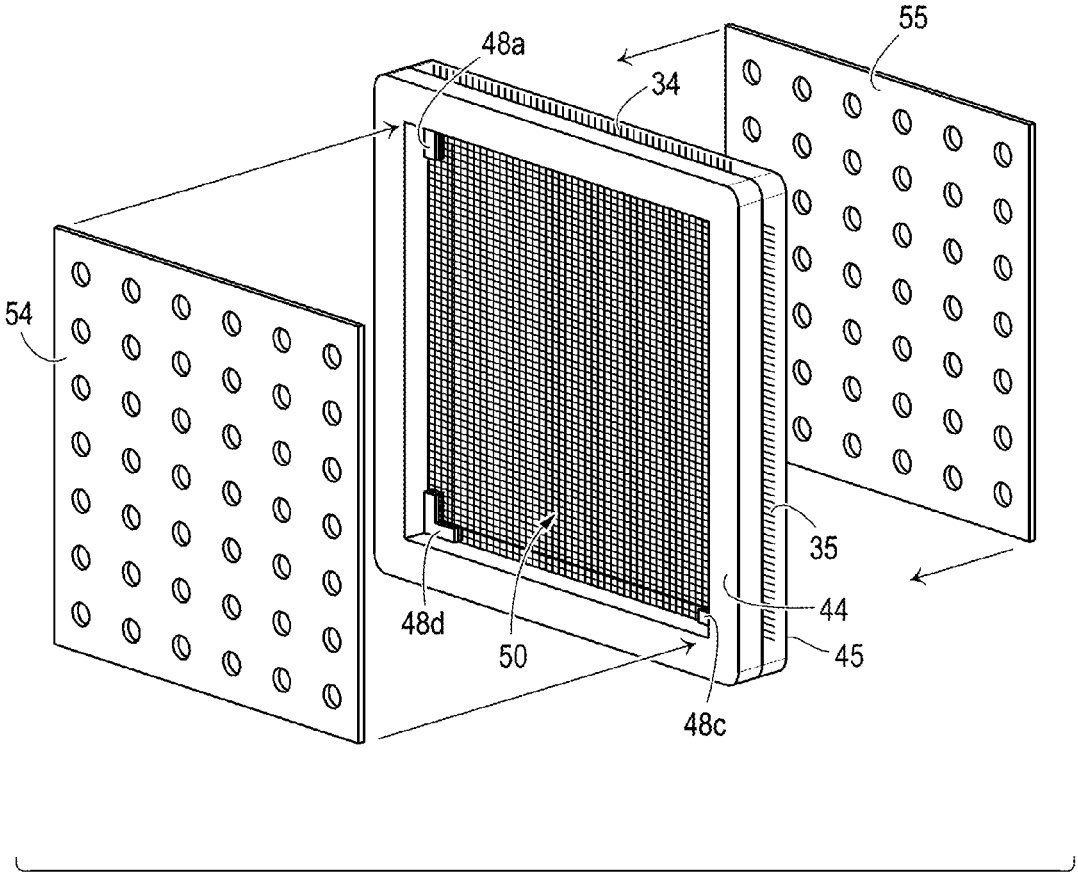
FIG. 6 is a perspective view showing two impregnation screens that are to be inserted into the nesting frames in a position adjacent to the assembled sheet.

In this embodiment, the first nesting frame 44 has tabs 48*a*-48*d* (48*b* not shown) located at the corners of its inner perimeter on the side of the first nesting frame 44 that is first inserted into the strand frame 12. The second nesting frame 45 is identical to the first nesting frame 44 in structure, and has tabs 49*a*-49*d*, respectively. Referring now to FIG. 6, the tabs 48, 49 are designed to support the insertion of the first and second impregnation screens 54, 55 within the inner perimeter of the first and second nesting frames 44, 45, respectively. The tabs 48, 49 serve to maintain the first and second impregnation screens 54, 55 in a stable position adjacent to respective sides of the assembled sheet 50, while preventing the first and second impregnation screens 54, 55 from being moved beyond the edges of the first and second nesting frames 44, 45, respectively, which are in contact with the assembled sheet 50. This is desirable in order to prevent the first and second impregnation screens 54, 55 from being pressed beyond the inner perimeter of the first and second nesting frames 44, 45, where they might alter the arrangement of the strands by coming in contact with the assembled sheet 50. It should be understood that any number, size, and location of the tabs 48, 49, respectively, around the inner perimeter of the first and second nesting frames 44, 45 could be used, for example, where more or less than four tabs are used in each nesting frame, and where the tabs 48, 49 are located at positions other than the corners of the first and second nesting frames 44, 45, respectively. For example, a single tab that extends around the entire inner perimeter of the first and second nesting frames 44, 45 could be used.

In FIG. 6, the first and second impregnation screens 54, 55, which are adapted to be inserted within the first and second nesting frames 44, 45, respectively, are shown with arrows indicating their respective insertion direction. The first impregnation screen 54 is inserted within first nesting frame 44 until it is in contact with tabs 48*a*-48*d*. Likewise, the second impregnation screen 55 is inserted within the second nesting frame 45 until it is in contact with tabs 49*a*-49*d* (see FIG. 4). In this embodiment, the first and second impregnation screens 54, 55, are separate units from the first and second nesting frames 44, 45, respectively. It should be understood that in the alternative, the first and second impregnation screens 54, 55 could be built into the first and second nesting frames 44, 45, respectively, such that for example the first nesting frame 44 and the first impregnation screen 54 would comprise a single unit.

As stated above, tabs 48, 49 prevent the first and second impregnation screens 54, 55 from making contact with the assembled sheet 50, in order to prevent the first and second impregnation screens 54, 55 from altering the arrangement of the strands which comprise the assembled sheet 50. The unidirectional arrangement of strands within a strand layer, coupled with the non-parallel orientation of adjacent strand layers, are important features affecting the structural integrity of the fully constructed composite material. For example, when orthogonally oriented strand layers are placed on top of another, a tightly arranged "checkerboard" pattern of strand layers is constructed. Not only does this strand arrangement maximize the structural integrity of the unimpregnated layer sets, but it also creates a highly uniform arrangement of spaces between the strands that will subsequently be filled with matrix component. The uniform and efficient placement of the matrix component within the assembled sheet 50 further acts to maximize the structural integrity of the composite sheet.

Figure 7:
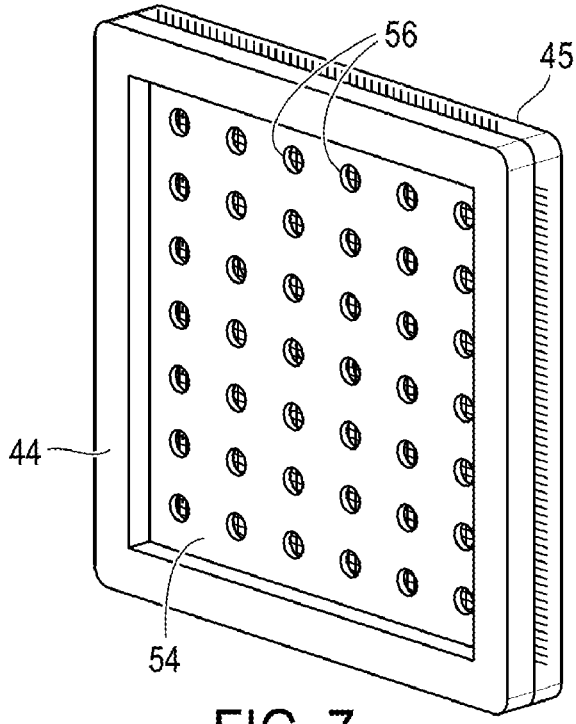
FIG. 7 is a perspective view showing one of the impregnation screens inserted into one of the nesting frames.

FIG. 7 is a perspective view of a first embodiment of the first impregnation screen 54 installed within the first nesting frame 44. The first impregnation screen 54 has screen holes 56, which will be used to allow for the distribution of a matrix component to the assembled sheet 50. In this embodiment, screen holes 56 are circular in shape and of a constant diameter across the surface of the first impregnation screen 54.

Figure 8:
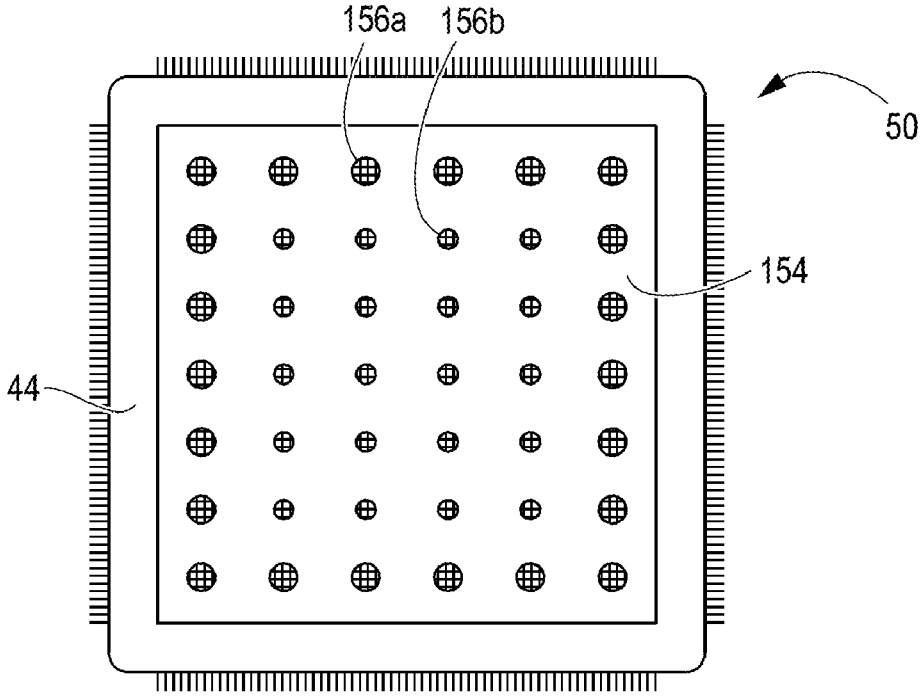
FIG. 8 is a front view showing an alternative embodiment of the impregnation screen shown in FIG. 7.

FIG. 8 shows a front view of an alternative embodiment of the first impregnation screen 154 installed within the first nesting frame 44. The first impregnation screen 154 has screen holes 156*a* located around the periphery of its surface, i.e. near the first nesting frame 44. Towards the center of its surface, the first impregnation screen 154 has screen holes 156*b*, which have a smaller diameter than the screen holes 156*a*. When the matrix component is introduced to the assembled sheet 50 through the screen holes 156*a*, 156*b*, this variation in screen hole sizing allows for less matrix component to be used, and results in more uniform distribution of the matrix component throughout the assembled sheet 50.

In the embodiments shown in FIGS. 7 and 8, screen holes 56, 156*a*, 156*b* are circular in shape. It should be understood that any number of screen hole shapes could be used, for example, square, oval, triangular, elongated slits, etc. It should be further understood that any number and relative placement of screen holes could be used in an impregnation screen to help achieve maximum distribution of the matrix component when it is introduced to the assembled sheet 50 through the screen holes. It will be obvious to one having ordinary skill in the art to vary the number, shape, size, and location of the screen holes to achieve the most efficient result based on, for example, the viscosity of the matrix component used.

It is preferable that separate impregnation screens, such as first and second impregnation screens 54 and 55, be brought into contact with either side of the assembled sheet 50. The use of an impregnation screen on both sides of the assembled sheet 50 allows for the matrix component to be applied, alternately or simultaneously, to both sides of the assembled sheet 50, which will lead to a more even and efficient distribution of the matrix component throughout the assembled sheet 50 and will tend to reduce the amount of matrix component that will need to be used. However, it should be understood that, in the alternative, an impregnation screen could be introduced to just one side of the assembled sheet 50.

Introduction of the matrix component to the assembled sheet 50 could be accomplished in a variety of ways. Preferably, the matrix component is allowed to flow by the force of gravity through the screen holes 56 located in the first and second impregnation screens 54, 55. In the alternative, the matrix component could be generally introduced onto the surface of the first and second impregnation screens 54, 55, or directed specifically into the screen holes 56 by the means of a spray device. B-staging—a process that uses heat or UV-light to remove the majority of a solvent from an adhesive—can also be used effectively to introduce the matrix component to the assembled sheet 50. B-staging works very well with volatile organic compound (VOC)-blended resins as the matrix component; after the B-staging process, very low resin content remains in the matrix component. It should be understood that other means of introducing the matrix component to the assembled sheet 50 are possible within the scope of this invention.

Figure 9:
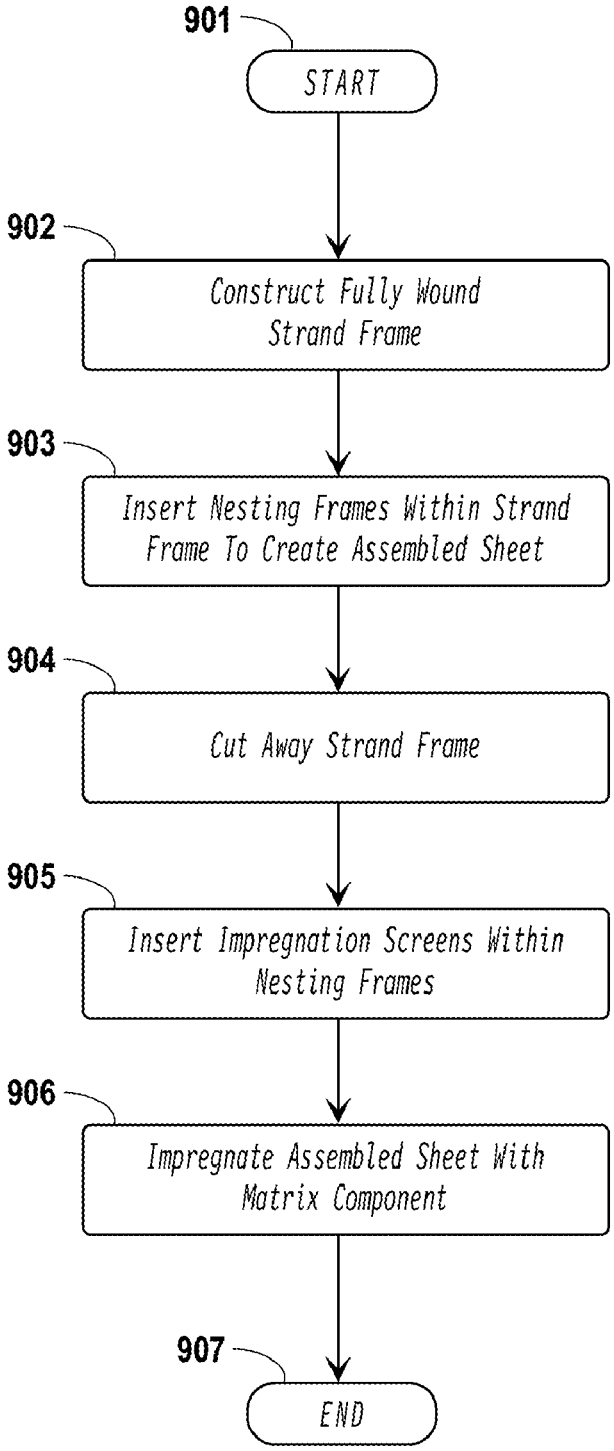
FIG. 9 is a flow chart showing the steps of an exemplary process in accordance with the present invention.

FIG. 9 is a flow chart showing the steps of an exemplary process for making a composite sheet, in accordance with the present invention. The process begins at step 901. At step 902, a fully wound strand frame 46 is constructed, having the desired number of strand passes arranged around the strand frame 12. The first and second nesting frames 44, 45 are inserted within the strand frame 12 to create the assembled sheet 50 at step 903. At step 904, a cutting mechanism is used to cut the strand frame 12 away from the assembled sheet 50. The first and second impregnation screens 54, 55 are inserted within the first and second nesting frames 44, 45, respectively, at step 905. At step 906, a matrix component is introduced to the assembled sheet 50. The process ends at step 907.

It should be understood that the steps described above could be performed in a variety of alternative orders. For example, the strand frame 12 could be cut away from the first and second nesting frames 44, 45 after the first and second impregnation screens 54, 55 have been inserted within the first and second nesting frames 44, 45, respectively, or after the assembled sheet 50 has been impregnated with the matrix component. Further, as stated above, the first and second impregnation screens 54, 55 could be part of the first and second nesting frames 44, 45, respectively, and therefore could be introduced at the time that the first and second nesting frames 44, 45 are inserted within the strand frame 12. Other modifications to the order of the above steps, as well as the omission or addition of one or more steps, are also possible within the scope of this invention.

As mentioned above, adjacent strand passes are most preferably arranged such that their respective unidirectional strands are arranged orthogonal to one another on either side of the strand frame 12. It should be understood that any non-parallel orientation of adjacent strand passes could be used. All of the strands passes are arranged around the strand frame 12 without any matrix component being added to the individual strand layers. It should be understood, however, that the strand 30, as carefully defined above, may be pretreated with a chemical, which may comprise a binding or hardening component. In the present invention, the individual strand layers are not treated with a matrix component until after the assembled sheet 50 has been created.

The orthogonal arrangement of adjacent strand passes substitutes for the structural integrity that is conventionally provided by separately impregnating individual strand layers (i.e. prepreg layers) before assembling the individual strand layers into a composite sheet. In the present invention, only after the assembled sheet 50 has been constructed and the first and second impregnation screens 54, 55 brought into adjacent positions thereto is the matrix component applied to the assembled sheet 50. In this fashion, a number of benefits can be achieved, including: (i) a reduction in the amount of matrix component used to fully impregnate the assembled sheet 50; and (ii) an increase in the contact time between the matrix component and the strands prior to evaporation of the volatiles contained in the matrix component. The significance of benefit (i) is that, in the composite material, the ratio of the volume of the strands to the volume of the matrix component is maximized; accordingly, the strength of the composite material is increased, while its weight is minimized. This benefit has particular importance with respect to ballistic applications, where the strength-to-weight ratio of for example, body armor and helmets, is of high value. In addition, the matrix component can be costly, and the efficiency of the above method results in cost savings as less matrix component needs be used to fully impregnate the assembled sheet 50. The significance of benefit (ii) is that it allows for the use of a matrix component having a higher volatile organic compound (VOC) content than would otherwise be permitted without sacrificing contact time.

The matrix component that is applied to the assembled sheet 50 through the first and second impregnation screens 54, 55 fills the gaps between and binds together the strand layers 36*a*, 36*b*, 37*a*, 37*b*. In addition to a standard binding component, the matrix component could include a radiation-absorbing component, such as Clearweld®, manufactured by Gentex Corporation of Carbondale, Pa. Clearweld is a compound that generates heat when it absorbs near infra-red (near-IR) light, such as that emitted by a laser, for example a Nd:YAG or diode laser.

In the present invention, Clearweld could be incorporated into the matrix component that is used to impregnate the assembled sheet 50. Thereafter, localized and precise activation of the Clearweld could be performed to generate a sufficient amount of heat to melt the matrix component, thus causing it to flow into the voids between the strand layers and binding them together. In addition, activation of the Clearweld allows for highly localized heating of the matrix component containing the Clearweld, without causing equivalent heating of any adjacent strand layers to occur, due to the fact that heat dissipation will not permit complete thermal transfer. Consequently, a matrix component could be used that has a higher minimum melting temperature than what would otherwise be allowable without thermally degrading the material that comprises the strand layers. For example, a polymer such as polyetherimide (PEI), having a melting point of approximately 350 degrees Centigrade (° C.), could comprise the matrix component. In this example, a polymer such as polyetheretherketone (PEEK), having a melting point of approximately 343° C., could thus comprise the strand layers. Because heat dissipation prevents equivalent heating of the strand layers, the melted PEI will not cause the PEEK strand layers to melt. It should be understood that many other polymers could be used for the matrix component and strand layers within the scope of this invention. The advantage of being able to use a polymer having a high minimum melting temperature in the matrix component is that the composite sheet formed therefrom will have improved performance characteristics, for example a higher density, thereby improving the ballistic quality of the composite sheet without adding significantly to its weight.

While the principles of the invention have been described above in connection with preferred embodiments, it is to be clearly understood that this description is made only by way of example and not as a limitation of the scope of the invention.

The invention claimed is:

1. A method of making a composite sheet, comprising:

assembling a first layer and a second layer positioned adjacent to the first layer to form an assembled sheet, the first and second layers each comprising an unbound, unidirectional array of strands, the strands of the first layer being non-parallel to the strands of the second layer; and adding a matrix material to the assembled sheet after the assembling step, wherein forming the assembled sheet further comprises positioning the first and second layers adjacent to another by pressing a nesting frame against one of the first and second layers, the nesting frame being adapted to fit within an inner perimeter of a winding frame, the winding frame having an outer perimeter around which the first and second layers are formed.

2. The method of claim 1, wherein the first and second layers are assembled by wrapping the strands around the winding frame.

3. The method of claim 2, wherein the first and second layers are assembled by rotating the winding frame.

4. The method of claim 3, wherein rotation of the winding frame is affected by joining the winding frame with a support means.

5. The method of claim 1, wherein the strands of the first layer are orthogonal to the strands of the second layer.

6. The method of claim 1, wherein the first and second layers are assembled from a continuous strand.

7. The method of claim 1, wherein the nesting frame has an inner perimeter and an outer perimeter, the inner perimeter of the nesting frame having an inner edge and an outer edge, the nesting frame having at least one tab located along its inner perimeter.

8. The method of claim 7, further comprising placing a screen adjacent to the at least one tab, the at least one tab being adapted to prevent the screen from extending beyond the inner edge.

9. The method of claim 1, further comprising adding the matrix material to the assembled sheet by positioning a screen adjacent to the assembled sheet, the screen having a plurality of holes formed therein, and causing the matrix material to flow through the plurality of holes and onto the assembled sheet.

10. The method of claim 1, further comprising adding the matrix material to the assembled sheet by the use of a B-staging process.

11. The method of claim 1, wherein the matrix material comprises a binding component and a radiation-absorbing component.

12. A method, comprising:

impregnating a substrate with a matrix material, the substrate comprising a plurality of strands, the plurality of strands comprising a first material, the matrix material comprising a binding component and a radiation-absorbing component, the first material having a lower minimum melting temperature than the binding component.

13. The method of claim 12, wherein the binding component comprises a polymer.

14. The method of claim 12, wherein when the radiation-absorbing component is activated, it generates an amount of thermal energy sufficient to melt the binding component.

* * * * *